US009493712B2

(12) United States Patent
Barroeta et al.

(10) Patent No.: US 9,493,712 B2
(45) Date of Patent: Nov. 15, 2016

(54) SEPARATOR FOR DESALTING PETROLEUM CRUDE OILS HAVING RAG LAYER WITHDRAWAL

(71) Applicants: Magaly C. Barroeta, Herndon, VA (US); Jose X. Simonetty, Kingwood, TX (US); Brian D. Albert, Fairfax, VA (US); Jennifer A. Gillett, Springfield, VA (US); Victor Alva, Everett, WA (US); Theodore T. Trier, Billings, MT (US); John R. Faber, Houston, TX (US)

(72) Inventors: Magaly C. Barroeta, Herndon, VA (US); Jose X. Simonetty, Kingwood, TX (US); Brian D. Albert, Fairfax, VA (US); Jennifer A. Gillett, Springfield, VA (US); Victor Alva, Everett, WA (US); Theodore T. Trier, Billings, MT (US); John R. Faber, Houston, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 217 days.

(21) Appl. No.: 14/185,212

(22) Filed: Feb. 20, 2014

(65) Prior Publication Data

US 2014/0251874 A1 Sep. 11, 2014

Related U.S. Application Data

(60) Provisional application No. 61/774,937, filed on Mar. 8, 2013.

(51) Int. Cl.

| | |
|---|---|
| ***C10G 21/30*** | (2006.01) |
| ***C10G 31/08*** | (2006.01) |
| ***C10G 33/02*** | (2006.01) |
| ***C10G 33/08*** | (2006.01) |

(52) U.S. Cl.

CPC ..... *C10G 21/30* (2013.01); *C10G 31/08* (2013.01); *C10G 33/02* (2013.01); *C10G 33/08* (2013.01)

(58) Field of Classification Search

CPC ..... C10G 33/04; C10G 33/02; C10G 32/02; C10G 33/00; C10G 33/06; C10G 33/08; C10G 1/002; C10G 1/045; C10G 21/30; C10G 31/06; B01D 17/06; B01D 17/04; B01D 17/12; B01D 21/009; B01D 17/0208; B01D 17/0211; B01D 17/0214; B01D 17/042; B01D 17/045

See application file for complete search history.

(56) References Cited

U.S. PATENT DOCUMENTS

| | | |
|---|---|---|
| 2,830,957 A | 4/1958 | Rhodes |
| 5,612,490 A | 3/1997 | Carlson et al. |

(Continued)

FOREIGN PATENT DOCUMENTS

| | | |
|---|---|---|
| WO | 0075262 A1 | 12/2000 |

OTHER PUBLICATIONS

PCT Application No. PCT/US2014/017347, Communication from the International Searching Authority, form PCT/ISA/220, dated Jun. 10, 2014, 13 pages.

*Primary Examiner* — Randy Boyer
*Assistant Examiner* — Juan Valencia
(74) *Attorney, Agent, or Firm* — Malcolm D. Keen; Glenn T. Barrett; Andrew T. Ward

(57) ABSTRACT

An improved separator for desalting petroleum crude oils which may be operated in a continuous manner under automatic control; the improved desalter is therefore well suited to modern refinery operation with minimal downtime. A portion of the emulsion layer is withdrawn from the desalter through external withdrawal ports according to the thickness and position of the emulsion layer with the selected withdrawal header(s) being controlled by sensors monitoring the position and thickness of the emulsion layer. The withdrawn emulsion layer can be routed as such or with the desalter water effluent to a settling tank or directly to another unit for separation and reprocessing.

12 Claims, 2 Drawing Sheets

(56) References Cited

U.S. PATENT DOCUMENTS 6,633,625 B2 10/2003 Jackson et al.
9,176,083 B2 * 11/2015 Surman ..... G01N 27/026
2002/0033356 A1 3/2002 Honda et al.
2010/0126936 A1 * 5/2010 Jones ..... E21B 21/063 210/708
2012/0024758 A1 2/2012 Love

* cited by examiner

SEPARATOR FOR DESALTING PETROLEUM CRUDE OILS HAVING RAG LAYER WITHDRAWAL

CROSS REFERENCE TO RELATED APPLICATION

This application relates and claims priority to U.S. Provisional Patent Application No. 61/774,937, filed on Mar. 8, 2013.

FIELD OF THE INVENTION

This invention relates to petroleum desalters and their operation.

BACKGROUND OF THE INVENTION

Crude petroleum contains impurities which include water, salts in solution and solid particulate matter that may corrode and build up solid deposits in refinery units; these impurities must be removed from the crude oil before the oil can be processed in a refinery. The impurities are removed from the crude oil by a process known as "desalting", in which hot crude oil is mixed with water and a suitable demulsifying agent to form a water-in-oil emulsion which provides intimate contact between the oil and water so that the salts pass into solution in the water. The emulsion is then passed into a high voltage electrostatic field inside a closed separator vessel. The electrostatic field coalesces and breaks the emulsion into an oil continuous phase and a water continuous phase. The oil continuous phase rises to the top to form the upper layer in the desalter from where it is continuously drawn off while the water continuous phase (commonly called "brine") sinks to the bottom from where it is continuously removed. In addition, solids present in the crude will accumulate in the bottom of the desalter vessel. The desalter must be periodically jet washed to remove the accumulated solids such as clay, silt, sand, rust, and other debris by periodically recycling a portion of the desalter effluent water to agitate the accumulated solids so that they are washed out with the effluent water. These solids are then routed to the wastewater system. Similar equipment (or units) and procedures, except for the addition of water to the oil, are used in oil producing fields to dehydrate the oil before it is transported to a refinery.

During operation of such units, an emulsion phase of variable composition and thickness forms at the interface of the oil continuous phase and the water continuous phase in the unit. Certain crude oils contain natural surfactants in the crude oil (asphaltenes and resins) which tend to form a barrier around the water droplets in the emulsion, preventing coalescence and stabilizing the emulsion in the desalting vessel. Finely divided solid particles in the crude (<5 microns) may also act to stabilize the emulsion and it has been found that solids-stabilized emulsions present particular difficulties; clay fines such as those found in oils derived from oil sands are thought to be particularly effective in forming stable emulsions. This emulsion phase may become stable and persist in the desalting vessel. If this emulsion phase (commonly known as the "rag" layer) does stabilize and becomes too thick, the oil continuous phase will contain too much brine and the lower brine phase will contain unacceptable amounts of oil. In extreme cases it results in emulsion being withdrawn from the top or bottom of the unit. Oil entrainment in the water phase is a serious problem as it is environmentally impermissible and expensive to remedy outside the unit. Also, it is desirable to achieve maximum coalescence of any remaining oil droplets entrained in the water continuous phase and thereby ensure that the withdrawn water phase is substantially oil free by operating the unit with the water continuous phase to be as close as possible to the high voltage electrodes in the unit without resulting in shorting across the oil to the water. If, on the one hand, the emulsion phase gets too thick the dosage of the demulsifying agent must be increased; on the other hand, if the water continuous phase gets too high or too low, the water phase withdrawal valve at the bottom of the unit called a "dump valve" must be correspondingly opened or closed to the degree necessary to reposition the water phase to the desired level in the unit and for this purpose, it is necessary to monitor the level and condition of the phases in the unit.

As described in U.S. Pat. No. 5,612,490 (Carlson et al), this has traditionally been done manually by operators periodically opening trycock valves to withdraw samples from fixed levels inside the desalter by using a "swing arm" sample line in the unit in place of, or in addition to, the trycock valves. In either case, an operator opens a sample valve to withdraw a sample and runs it over a smooth surface such as metal to visually determine if the withdrawn phase is oil or water continuous or if it is a stable emulsion phase. No accurate quantitative information is available using this method and, further, because desalters typically operate at temperatures ranging between about 90 to 150° C. and pressures from 5 to 50 barg (dehydrators typically run at lower temperatures and pressures), there is a danger of the sample flashing and burning the operator. Also, the withdrawn sample may be different in phase identity at the reduced temperature and pressure outside the unit than it is inside the unit. Other methods include the use of Agar probes or capacitance probes, some of which can give information about the water content of an oil phase, while others merely indicate if the phase is oil or water continuous.

U.S. Pat. No. 5,612,490 describes an improved desalter operation in which the level of the water continuous phase is determined by first withdrawing a liquid sample from a known level within said equipment and passing it outside, and measuring an electrical property of the withdrawn sample outside the desalter to determine if the sample is drawn from the oil phase or the water phase. These steps are repeated as many times as desired by using the existing sample withdrawal equipment to withdraw additional samples from different known vertical positions or levels in the unit to obtain a profile of the phase levels in the unit. While this method offers certain advantages, it is time-consuming, expensive in terms of the labor requirements to withdraw the samples and test their electrical properties in separate equipment, and still does not remove the safety risk to the operators discussed above (sample flashing and burning)

Another problem encountered during desalter operation is that the feed mixture of oil and water may, depending upon the type of crude or combination of crudes as well as the length of time during which the oil and water remain in contact in the desalting process, the conditions in the desalter, the proportion of solids in the crude and other factors, form a stable emulsion layer which accumulates progressively in the desalter vessel. This emulsion layer in the separator vessel may vary in thickness from several centimetres to more than one metre. When an excessive stable emulsion layer builds up, it becomes necessary to withdraw the emulsion layer and process it for reintroduction into the refinery.

It is desirable to maintain a constant amount of emulsion in the separator in order to maximize the separation capacity and reduce the contamination of the outgoing oil and water. If the emulsion layer becomes too thick, excessive electrical loading, erratic voltage readings, or carryover of water into the oil or loss of oil into the water layer may result. Traditional remedies included adding chemical emulsion breakers, reducing processing rates, shutting down the desalter to remove the emulsion and increasing the size of the separator tank. These responses are inadequate with many crude oils that are processed today, especially if higher rates of processing are required. Shutdown or reduction of feed rate is therefore uneconomic while the use of chemical demulsifiers may cause problems in downstream catalytic units sensitive to deactivation by the chemicals. Formation of a stable emulsion "rag" layer can therefore lead to early shutdown of the desalting processes, causing serious disruption of refinery operation, including premature shut down, deactivation of catalysts, and the fouling/plugging of process equipment.

Processing crudes with high rag layer formation tendencies in the current desalter configurations may cause poor desalting (salt removal) efficiency due to solids build up at the bottom of the vessel, and/or a solids stabilized rag layer leading to erratic level control and insufficient residence time for proper water/oil separation. Solids stabilized emulsion layers have become a major desalter operating concern, generating desalter upsets, increased preheat train fouling, and deteriorating quality of the brine effluent and disruption of the operation of the downstream wastewater treatment facilities.

While none of the current desalter configurations have the capability to remove the emulsion layer for treatment and reintroduction into the refinery, US 2012/0024758 (Love) proposes a technique in which the thickness of the emulsion "rag" layer is withdrawn from the separator vessel at a rate that maintains the height of the emulsion layer approximately constant so as to permit withdrawal of the rag layer at a fixed level from the vessel. The withdrawn emulsion is then processed outside the vessel through a stacked disk centrifuge. While this method has the advantage of handling the troublesome rag layer so as to maintain proper functioning of the separator, it is not optimally adapted to continuous desalter operation since it requires the fixed location of the emulsion layer to be determined by existing techniques such as those described briefly above. For this reason, use of the method may be uncertain, time-consuming or expensive and, in the event of changes in crude composition, problematical as a result of variations in the thickness or position of the emulsion layer which cannot be readily accommodated

SUMMARY OF THE INVENTION

We have now developed an improved separator for desalting petroleum crude oils which may be operated in a continuous manner under automatic control; the improved desalter is therefore well suited to modern refinery operation with minimal downtime. Briefly, a portion of the emulsion layer is withdrawn from the desalter through one or more external withdrawal headers according to the thickness and position of the emulsion layer with the selected withdrawal header(s) being controlled by sensors monitoring the position and thickness of the emulsion layer. The withdrawn emulsion layer can be routed as such or with the desalter water effluent to a settling tank or directly to another unit for separation and reprocessing.

According to the present invention, the petroleum desalter comprises: a desalter vessel having a feed inlet for admitting a mixture of crude oil to be desalted with desalting water to form (i) a settled water layer containing salts dissolved from the oil in the lower portion of the vessel, (ii) a settled supernatant desalted oil layer in the upper portion of the vessel and (iii) an emulsion layer formed from the oil and the water between the settled water layer and the settled oil layer, a water outlet at the bottom of the vessel for removing water from the water layer, an oil outlet at the top of the vessel for removing desalted oil from the oil layer, a plurality of vertically spaced emulsion outlets for removing emulsion from the emulsion layer, a level sensor system to indicate a lower interface between the top of the water layer and the bottom of the emulsion layer and an upper interface between the top of the emulsion layer and the bottom of the oil layer, a water outlet control valve in the water outlet operable by the level sensor system to regulate the water outlet control valve in accordance with the water level indicated by means of the sensor so that the bottom of the emulsion layer is maintained above a minimum water level, an emulsion outlet valve on each of the emulsion outlets operable by the level sensor system to regulate the emulsion outlet valve on each of the emulsion outlets in accordance with the emulsion level indicated by the level sensor system so that at least one of the emulsion outlet valves is opened to remove emulsion from the vessel when the top of the emulsion layer in the vessel rises to a maximum emulsion level.

In operation, the desalting method is operated in the desalting unit by mixing a crude oil to be desalted with desalting water and passing the mixture of oil and water to a desalter vessel to form (i) a settled water layer containing salts dissolved from the oil in the lower portion of the vessel, (ii) a settled supernatant, desalted oil layer in the upper portion of the vessel and (iii) an emulsion layer formed from the oil and the water between the settled water layer and the settled oil layer, monitoring the levels of the layers in the vessel to indicate a lower interface between the top of the water layer and the bottom of the emulsion layer and an upper interface between the top of the emulsion layer and the bottom of the oil layer, maintaining the level of the bottom of the emulsion layer in the vessel above the water level in response to the indicated water level, removing emulsion from the emulsion layer through at least one of a plurality of vertically spaced emulsion outlets in the vessel when the top of the emulsion layer in the vessel is indicated to rise to a maximum level

DRAWINGS

DETAILED DESCRIPTION

Figure 1:
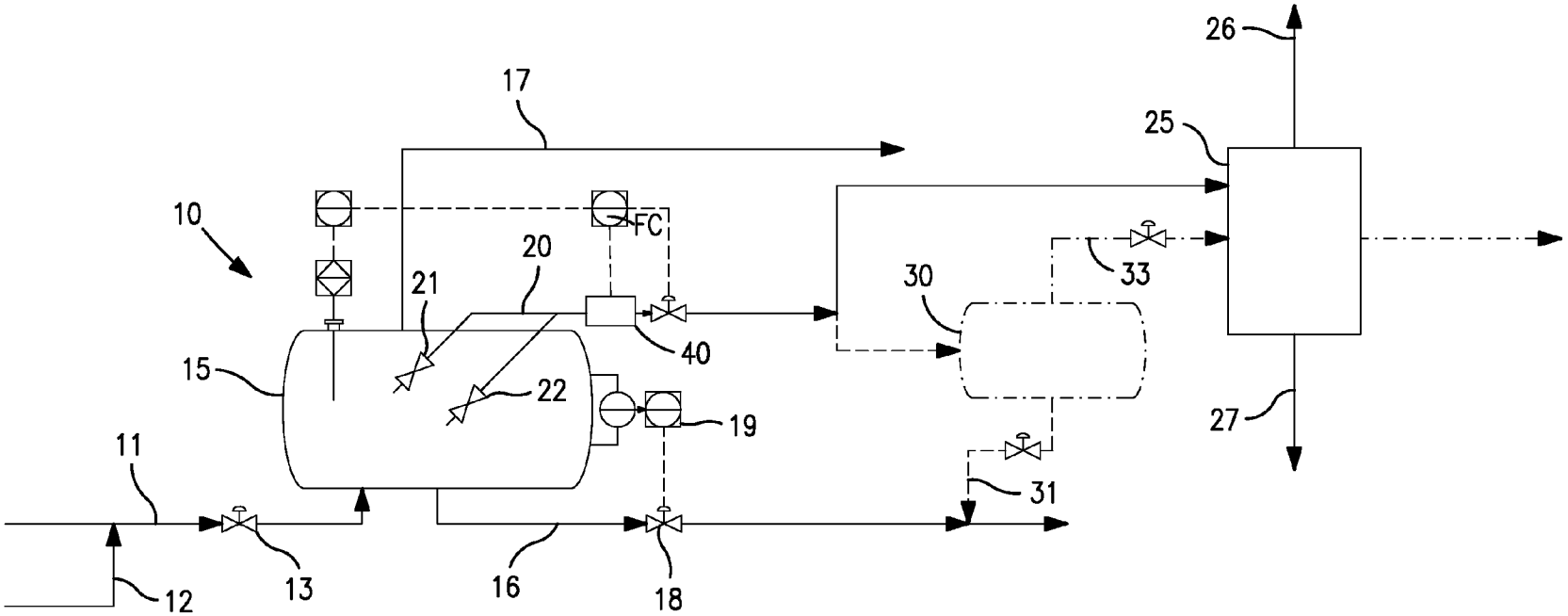
FIG. 1 is a simplified diagram of a petroleum crude desalter unit with multiple emulsion layer withdrawal ports and control circuits for monitoring and controlling the withdrawal of the emulsion layer.

In its most common form with electrostatically induced separation in the settler vessel, the desalting process first mixes the crude or crude blend with water using a mixing valve or other equivalent device to produce an oil/water emulsion to ensure good contact between the oil and the water to favor removal of soluble salts by the water as well as promoting separation of separated solids. The resulting emulsion is then exposed to an electric field to initiate the coalescence of the water droplets inside of the desalter vessel or separator. With time, the feed emulsion separates into an aqueous phase, an oil phase, and a solids phase which settles to the bottom of the vessel and is withdrawn there. The aqueous phase contains salts and suspended solids derived from the crude oil. The oil phase is recovered as desalted crude, from the top of the desalter vessel and normally is sent to an atmospheric distillation unit for further processing into feedstocks for motor fuel, lubricants, asphalt and other ultimate products and uses such as petrochemical production. The aqueous phase is further processed in a water treatment plant. Depending upon the crude or combination of crudes and the mixing intensity, an excessive stable emulsion (rag) layer may form in between the oil phase and the aqueous phase. Typically, this emulsion layer which contains 20 to 70% v/v water accumulates until it becomes too close to the electrodes of the desalter. This uncontrolled growth, if continued, may ultimately short out the electrodes, resulting in a complete shutdown of the desalter with a loss of oil and water separation. If, simultaneously the emulsion layer is allowed to grow downwards, an unacceptable oil contamination of the aqueous phase may ensue, exceeding the capability of the associated water treatment plant to process the brine to an acceptable environmental quality. Prudent operating practice therefore calls for the water level to be maintained at a substantially constant level in the vessel.

Conventionally, the practice is to process the crude with a single stage desalter. Some units operate with two separator vessels in series where the water is cascaded counter currently to the crude to maximize salt removal. The separator vessel typically uses gravity and electric charge to coalesce and separate oil and water emulsions into the oil and the wastewater effluent. Separators are available from a variety of commercial sources.

The wash water used to treat the crude oil may be derived from various sources and the water itself may be, for example, recycled refinery water, recirculated wastewater, clarified water, purified wastewater, sour water stripper bottoms, overhead condensate, boiler feed water, clarified river water or from other water sources or combinations of water sources. Salts in water are measured in parts per thousand by weight (ppt) and range from fresh water (<0.5 ppt), brackish water (0.5-30 ppt), saline water (30-50 ppt) to brine (over 50 ppt). Although deionized water may be used to favor exchange of salt from the crude into the aqueous solution, de-ionized water is not normally required to desalt crude oil feedstocks although it may be mixed with recirculated water from the desalter to achieve a specific ionic content in either the water before emulsification or to achieve a specific ionic strength in the final emulsified product. Wash water rates may be between approximately 5% and approximately 7% by volume of the total crude charge, but may be higher or lower dependent upon the crude oil source and quality. Frequently, a variety of water sources are mixed as determined by cost requirements, supply, salt content of the water, salt content of the crude, and other factors specific to the desalting conditions such as the size of the separator and the degree of desalting required.

The emulsion layer which forms in the desalter vessel is removed from the vessel for separate processing, e.g. by centrifugal separation, full or partial vaporization of the water from the emulsion layer, atomization and partial heating followed by gravity settling/centrifugal separation, recycle of the layer to the desalter feed, filtration separation, membrane separation, ultrasonic disruption followed by gravity settling/centrifugal separation, dilution with a hydrocarbon stream followed by electrostatic coalescence and settling. Preferably, all or part of the withdrawn emulsion layer is taken to a settler tank in which it can be resolved into its two constituent phases, if necessary by the addition of demulsifiers or other means. Additional water may be added to the settler if this will improve resolution of the withdrawn emulsion.

The desalter vessel or separator according to the invention has multiple emulsion withdrawal ports or headers located at different vertical heights on the vessel to permit the emulsion to be withdrawn selectively according to its position in the vessel and its thickness, i.e. its vertical extent in the vessel. By selective use of the withdrawal ports the thickness of the emulsion layer and its position in the desalter vessel can be regulated, optionally with automatic control of the withdrawal using probes, density profilers or composition monitors which control the withdrawal in accordance with the oil/water ratio of the withdrawn material.

Depending upon the crude or combination of crudes and the mixing intensity, the emulsion layer may form between the oil phase and the aqueous phase in the desalter vessel. Crudes with high solids contents present a particularly intractable problem since the presence of the solids, often with particle sizes under 5 microns, may act to stabilize the emulsion, leading to a progressive increase in the depth of the rag layer with the stability of the emulsion varying inversely with decreasing particle size. The present invention is especially useful in its application to challenged crudes containing high levels of solids, typically over 5,000 ppmw but it may also be applied to benefit the desalting of high asphaltene content crudes which also tend to stabilize the emulsion layer in the desalter.

During the desalting process, the thickness of the emulsion layer will increase if no measures are taken to withdraw it from the vessel. The top of the emulsion layer must not, as noted above, exceed a certain fixed height in the vessel if arcing or shorting from the electrodes of the desalter is to be avoided. The rate of water addition is determined by the gravity of the crude oil. Equally, the need to maintain a certain volume of water in the vessel presents a requirement to maintain the thickness and position of the emulsion layer within certain predetermined limits. The position of the emulsion layer cannot be controlled by varying the rate of water addition independently of the oil rate so that if the thickness or position of the emulsion layer is to be varied by control of the flow rate of the oil, the water rate has to be adjusted accordingly.

The composition of the emulsion layer is not constant but varies with height in the vessel: at the bottom, where the layer meets the water, the oil/water ratio is at a low level while at the top of the layer next to the oil layer, the emulsion has a relatively higher oil/water ratio. For optimal operation, the emulsion which is being withdrawn from the vessel should not have excessive amounts of water or oil in it. The emulsion has to be processed to recover as much oil as possible and for this reason, excessive amounts of water will complicate the processing of the withdrawn emulsion and similarly, since the water which is removed from the emulsion has to be fit for ultimate discharge after necessary processing, excessive amounts of oil will also complicate processing. As a typical guideline, it is preferred that the water content of the emulsion layer withdrawn from the vessel will be from about 20 to about 70 volume percent with up to about 15,000 ppmw solids (organic and inorganic) although different values may be used according to the needs of the desalter, the capabilities of the emulsion processing unit, the waste water treatment unit, and the salt levels permissible in the downstream oil processing units. Because the thickness of the emulsion layer varies with time and processing conditions absent any control being taken, the optimal levels at which an emulsion of the appropriate oil/water ratio can be withdrawn will vary correspondingly. Withdrawal can be effected both batchwise (intermittently) and continuously. Batchwise withdrawal can be an effective technique and can be used when the water content of the emulsion layer is consistently under 20 volume percent but continuous withdrawal at a rate dependent upon the oil and water flow rates and the rate of emulsion generation is generally to be preferred, consistent with modern plant practice so as to maintain constant oil and water composition and desalting. The present invention enables this to be done automatically using commercially available process control techniques in combination with one another.

FIG. 1 is a simplified diagram of a petroleum crude desalting unit according to the invention. The desalter unit 10 receives crude oil through line 11 and water through line 12; the oil and water are mixed together vigorously in mixing valve 13 and the mixture then passes into desalter vessel or settler 15 where the oil and water layers separate under the influence of an electrostatic field induced by high voltage electrodes in the top of the vessel (not shown as conventional). The brine containing dissolved salts and some solids is removed from the bottom of the vessel through line 16 under the control of water outlet control valve 18 linked to a water level probe 19 situated inside the vessel as described in more detail below. The separated, desalted oil is taken from the top of the vessel through line 17 and sent to the next refining unit in sequence in the refinery. An emulsion layer removal header 20 is connected to an upper withdrawal nozzle 21 and a lower withdrawal nozzle 22 located in the vessel to allow the withdrawal of a portion of the emulsion layer during the normal desalting operation. The nozzles are placed at different heights to provide different locations so as to optimize the withdrawal point to extract the most problematic portion of the emulsion layer from the vessel.

The withdrawn emulsion layer is then sent to an emulsion treatment unit 25 where it is separated into oil and aqueous phases. Separation methods include, but are not limited to: centrifugal separation, full vaporization of the emulsion layer water, atomization and partial heating followed by gravity settling/centrifugal separation, recycle of the layer to the desalter feed, filtration separation of the layer, membrane-enhanced separation, ultrasonic disruption followed by gravity settling/centrifugal separation, dilution with a hydrocarbon stream followed by gravity settling/centrifugal separation, dilution with a hydrocarbon stream followed by electrostatic coalescence and settling separation. A favorable method of emulsion separation with solids-stabilized emulsions is by centrifugation using a decanter centrifuge. Decanter centrifuges, which combine a rotary action with a helical scroll-like device to move collected solids along and out of the centrifuge bowl, are well adapted to handling high solids emulsions, including those with solids up to about 1 mm particle size and are available in two or three phase types (one liquid phase plus solid or two liquid phase plus solid). Depending on conditions, solids contents up to 25 weight percent can be tolerated by this type of unit although in most cases, the emulsion layer will not have more than 10 weight percent solids. The decanter centrifuge is capable of efficiently removing the liquids from the solids by the compacting action which takes place as the solids are progressively forced down the tapered portion of the rotating bowl towards the solids discharge port while the oil and water can be separately discharged as a single phase or as two separate phase from the opposite end of the bowl. If further separation of the oil and water is required to provide optimal clarification of the liquid phase, a stacked disk centrifuge may be used with its enhanced liquid treatment capability.

The oil recovered from the emulsion is sent through line 26 to the refinery for processing. The recovered water phase is sent to the water treatment plant (WWT, not shown) through line 27. Optionally, if the quality of the recovered oil in line 26 is acceptable, it can be blended with the primary desalted oil in line 17. Preferably, the recovered water phase in line 27 is mixed with the brine water stream in line 16.

As an additional enhancement, the withdrawn emulsion layer may optionally be routed to a water settling drum 30 to remove easily resolved water which is removed via line 31 to the brine stream in line 16. The settled emulsion layer can be withdrawn from settler 30 to be routed to the emulsion treatment unit 25 by way of line 33 for treatment with the emulsion withdrawn withdrawn from the vessel; after treatment in unit 25, the recovered water, recovered oil and solids are routed through lines for reintroduction into the refinery and appropriate treatment. By removing the water which settles out of the emulsion on standing this option reduces the volume of emulsion which must be reprocessed in treatment unit 25.

The two emulsion withdrawal nozzles shown in FIG. 1 are located at the levels in the vessel which are expected to correspond to the emulsion layer locations at which the composition of the emulsion is at the limits of the water/oil ratio suitable for processing in the emulsion treatment unit. For example, assuming that the outer limits on the water/oil ratio are 30/70 and 70/30, the upper emulsion withdrawal nozzle 21 will be set at the level at which the water oil ratio of the emulsion is expected to be 30/70 (v/v) in normal operation; conversely, the lower withdrawal nozzle 22 will be set at the level where the water/oil ratio is expected to be 70/30 (v/v) in normal operation. In FIG. 1 only two emulsion withdrawal nozzles are shown but it is preferred to use multiple withdrawal nozzles as described below to permit the emulsion to be withdrawal from various levels in the vessel as the thickness and location of the emulsion layer changes in normal operation. A flow meter and control valve 40 will regulate the withdrawal rate with control over each individual withdrawal nozzle.

Figure 2:
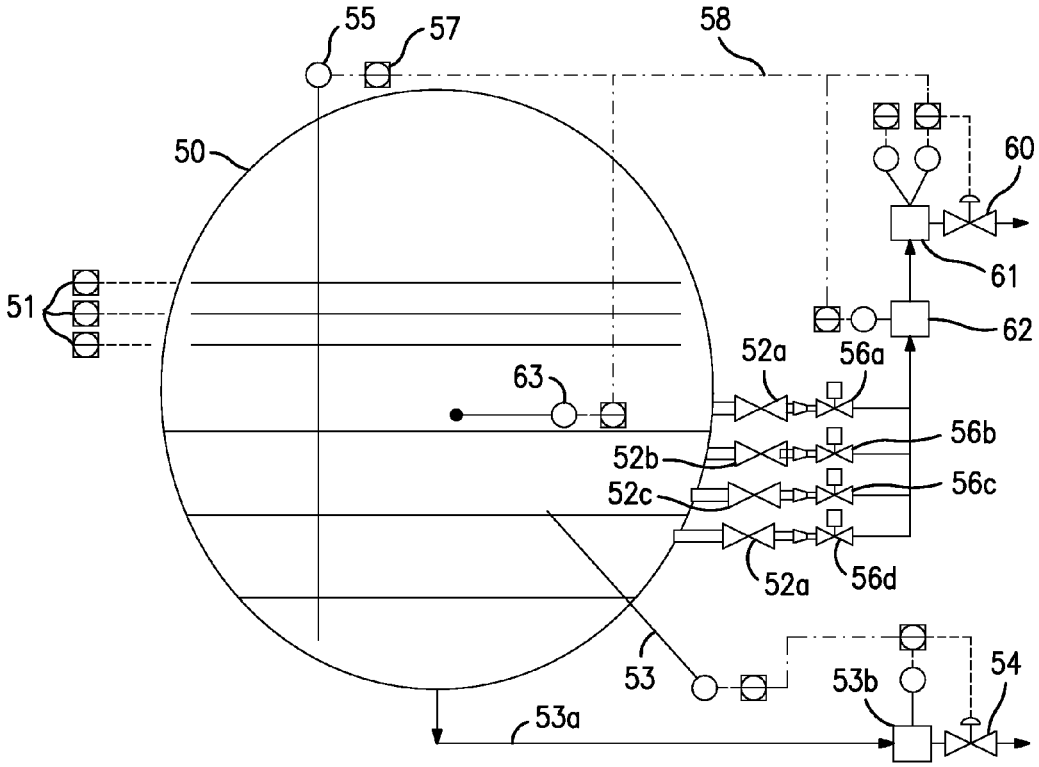
FIG. 2 is a simplified diagram of a petroleum crude desalter unit with multiple emulsion layer withdrawal ports and control circuits with level probes and a density profiler for monitoring and controlling the withdrawal of the emulsion layer.

The operation of the desalter may be controlled with a density profiler as shown in FIG. 2 which shows a cross-section of a desalter vessel 50 with electrostatic grids 51 and four emulsion layer withdrawal ports 52*a*, 52*b*, 52*c*, 52*d*, spaced at differing vertical locations at the side of the vessel. As with the withdrawal nozzles of FIG. 1, they are located at the levels in the vessel which are expected to correspond to the emulsion layer locations at which the composition of the emulsion is at the limits of the water/oil ratio suitable for processing in the emulsion treatment unit. For example, assuming that the outer limits on the water/oil ratio are 30/70 and 70/30, the upper emulsion withdrawal port 52*a* will be set at the level at which the water oil ratio of the emulsion is expected to be 30/70 (v/v) in normal operation; conversely, the lower withdrawal nozzle 52*d* will be set at the level where the water/oil ratio is expected to be 70/30 (v/v) in normal operation.

A lower water probe 53 is set at approximately the same level as the lowest withdrawal port 52*d* and is set to activate brine flow control valve 54 through line 53*a* and valve controller 53*b* when the water level (top of the water layer at a predetermined water/oil ratio) rises to the level of the probe. When this occurs, brine flow control valve 54 is opened to let the brine out of the vessel and reduce the water level in the vessel and so to hold it at a substantially constant level. Control thus depends on raising the portion of the emulsion layer which contains more than a selected proportion of oil above the lower water probe although some suspended oil may remain in the water layer below the level of the probe. The lower water level probe which controls the brine outlet valve uses its ability to measure small amounts of oil in water to maintain a very high percentage of water above the bottom of the vessel, e.g. one meter above vessel bottom. This allows suspended oil in the water phase to separate, thus inhibiting oil undercarry as a primary control function. This probe, acting independently of the emulsion withdrawal control sensors therefore establishes this as a lower limit for the emulsion layer. Since this suspended oil will be drawn off with the brine, the relative amount of oil in the water is selected so that it can be handled in the waste water treatment unit.

Water level probes are commercially available, for example, the Agar™ probes from Agar Corporation Inc., 5150 Tacoma Drive, Houston, Tex. 77041. Probes of this type typically provide continuous 4 to 20 mA output signals that are proportional to the water/oil ratio at their individual locations inside the desalter with the output signal suitable for conventional monitoring and control systems.

Withdrawal of the emulsion layer takes place through withdrawal ports 52*a*, 52*b*, 52*c*, 52*d*, each with its individual control valve, 56*a*, 56*b*, 56*c*, 56*d*, under the control of density profiler 55 acting through monitoring and control system 57 connected through line 58 (connections to valve controllers not shown for clarity, conventional in type). The density profiler measures the density and the extent of different phases within a vessel so that the interface of the oil and water phases can be monitored and controlled. One type of density profiler is described in U.S. Pat. No. 6,633,625 (Jackson/Johnson Matthey) using collimated ionizing radiation beams with an axially distributed radiation detector array in which each detector is associated with one of the beams to produce an output signal in response to incident radiation. In a typical commercial density profiler a dip pipe extending into the vessel through a flange holds an array of low-energy gamma sources with a collimator with holes at each source level. These holes direct a narrow beam of radiation toward a selected detector so that each source is matched to the radiation source in the same plane. The liquid between the dip pipes will attenuate the radiation with the intensity of the detected radiation proportional to the density of the intervening liquid, this providing an output signal indicative of the liquid at each source/detector plane. The outputs from the detectors are transmitted for analysis, for instance, by wire or fiber-optic link to a programmable logic controller that collects the information and calculates the density profile which is used to control the emulsion withdrawal through valves 52*a*, 52*b*, 52*c*, 52*d* according to the position of the top of the emulsion layer. If desired, the profiler may be adapted to indicate the liquid composition only in the region where the emulsion layer is expected to form; this may reduce cost and simplify operation. Various density profilers are commercially available such as the Nitus™ system from Thermo Fisher Scientific, the Tracerco™ Profiler from Johnson Matthey, the Delta Controls IPT (Interface Position Transmitter) and the Ohmart Vega MDA interface profiler. The profiler typically operates from an internal drywell with multi-level radiation sources with internal or external detectors for each interface level. The type with internal drywell detectors has the advantage of easy installation while the external detectors are less sensitive to temperature and do not require cooling to preserve their integrity.

Under the control of the density profiler, withdrawal of the emulsion may be made through any one of the four withdrawal ports according to the oil/water ratio of the emulsion layer above the upper water level fixed by lower water probe 53 and below the permitted upper level of the emulsion layer (set according to the maximum permissible water/oil ratio at which grid shorting is possible). In normal operation of the desalter, continuous emulsion withdrawal is the preferred mode of operation with emulsion being withdrawn at a rate equal to its rate of generation so that optimal, stable conditions for the removal of dissolved salts are maintained in the desalter. The use of the intermediate withdrawal ports 52*b*, 52*c*, between the uppermost and lowermost ports is useful since they permit withdrawal of emulsion with an oil/water ratio between the maximum and minimum values set for the lower water probe and the upper emulsion layer probe (or in the density profiler), with selection of the withdrawal port or ports being made according to the emulsion composition (oil/water ratio) most suited to treatment in the emulsion treatment unit 25. Withdrawal may be effected through one or more of the ports simultaneously. If the emulsion layer has grown to extend itself downwards in the vessel, a sequential withdrawal sequence may be used with withdrawal commenced at the lowest withdrawal port until the water level has reached that port, at which time, withdrawal at that level can be terminated and initiated through the higher level ports in turn as the water level in the vessel rises.

Further control of the flow rate of the withdrawn emulsion may be effected by flow rate control valve 60 under control of a flow rate/density meter 61, preferably a coriolis meter, connected into the monitoring/control system as briefly indicated. An inline water/oil probe 62 such as an Agar probe may be used in emulsion header 63 as an additional monitor on the emulsion withdrawal. The emulsion flow rate control valve is modulated to meet a certain flow set point. The flow set point can be cascaded to profiler 55, which can be programmed to give a single signal to designate the top of the emulsion layer, bottom of the emulsion layer, or to a designated level between the two, e.g. the center of the emulsion layer. In this way, the flow rate set for stable desalter operation can be maintained by withdrawing emulsion from one or another of the withdrawal ports.

As a backup to the density profile, an upper water probe 63 integrated into the monitoring/control system as shown can also be used to control withdrawal of the emulsion layer in the manner described for FIG. 1.

Alternatively, if the profiler is not available, the emulsion layer withdrawal control valve can be under the control of the upper water probe as described for FIG. 1 or the in-line water probe. Control by the upper water probe is preferred for the purpose of modulating the emulsion flow rate control valve 60 as in-line probe 62 might not able to successfully modulate a control valve.

The upper water probe monitors the water/oil ratio content from its position in the oil phase just below the lower grid. This provides real-time detection of the rate and extent of emulsion growth which takes place only in the upward direction as the lower water probe 53 and the brine discharge valve independently limit downward growth. The monitoring function of the upper water level probe provides warning of emulsion growth and allows time for corrective measures to prevent grid shorting by setting emulsion withdrawal through one or the other of the withdrawal ports to be initiated, with withdrawal effected according to the optimally determined strategy for handling the emulsion in the emulsion treatment unit.

An optional addition to the system is an in-line monitor to determine the water content of the crude feed; this should be located as far as possible upstream of the desalter to provide advanced warning of a wet/contaminated crude feed, so as to avoid upsets typically resulting from tank switching and/or the introduction of slop oil. Another option is to install a probe below the lower water level probe to monitor the condition of the water phase, providing an alarm condition on the presence of suspended oil that does not readily separate and that threatens the condition of the brine effluent. This is of particular value when low-quality sources of wash water (e.g. stripped or straight sour water) are utilized that can upset the separation process and form stable oil-in-water mixtures (reverse emulsions). This probe is also useful during mud-washing operations when accumulated solids are removed from the bottom of the settler vessel.

The main benefits of withdrawal of the emulsion layer are: (i) Controlled desalter emulsion layer volume through continuous/intermittent withdrawal; (ii) Improvement of the desalter operation with the objective of reducing the adverse effects on waste water treatment; and (iii) Increase in site capability to manage high solids and challenged crudes while minimizing the use of chemicals and reducing the reprocessing of brine and emulsions in tankage.

OPERATIONAL EXAMPLE

An experimental refinery field test was carried out to test the ability to control the volume of the emulsion layer in the desalter by continuous withdrawal, to understand how the emulsion layer properties (solids and oil content) change when continuous withdrawal of the emulsion layer is in operation and to quantify the growth rate of the emulsion layer under experimental conditions. Test results demonstrated that emulsion layer was consistently withdrawn at an estimated flow rate of 191 to 207 $m^3$/day (1.2 to 1.3 KBD) and the emulsion layer height was reduced from 150 cm. to about 90 cm (from about 5 ft. to 3 ft.) in approx. 36 hours. The emulsion layer growth rate was estimated to be 40 $m^3$/day (250 BPD), therefore the required withdrawal rate to maintain emulsion layer volume is likely to be lower than the tested rate for that particular commercial desalter. The emulsion growth rate after withdrawal was terminated brought the emulsion layer back to the original level after 64 hours with the emulsion reforming by the gradual appearance of increased solids followed by a build-up of oil. It was concluded that emulsion layer withdrawal can effectively control emulsion layer growth.

The invention claimed is:

1. A petroleum desalter which comprises:

a desalter vessel having a feed inlet for admitting a mixture of crude oil to be desalted with desalting water to form (i) a settled water layer containing salts dissolved from the oil in the lower portion of the vessel, (ii) a settled supernatant desalted oil layer in the upper portion of the vessel and (iii) an emulsion layer formed from the oil and the water between the settled water layer and the settled oil layer, a water outlet conduit at the bottom of the vessel for removing water from the water layer, an oil outlet conduit at the top of the vessel for removing desalted oil from the oil layer, a plurality of vertically spaced emulsion outlets for removing emulsion from the emulsion layer, a level sensor system to indicate a lower interface between the top of the water layer and the bottom of the emulsion layer and an upper interface between the top of the emulsion layer and the bottom of the oil layer, a water outlet control valve in the water outlet conduit operable by the level sensor system to regulate the water outlet control valve in accordance with the water level indicated by means of the sensor so that the bottom of the emulsion layer is maintained above a minimum water level, an emulsion outlet valve on each of the emulsion outlets operable by the level sensor system to regulate the emulsion outlet valve on each of the emulsion outlets in accordance with the emulsion level indicated by the level sensor system so that at least one of the emulsion outlet valves is opened to remove emulsion from the vessel when the top of the emulsion layer in the vessel rises to a maximum emulsion level.

2. A desalter according to claim 1 in which the level sensor system is connected to control circuitry to open the emulsion outlet valve on each of the emulsion outlets when the oil/water ratio of the emulsion layer at the maximum emulsion level attains a predetermined value.

3. A desalter according to claim 2 in which the level sensor system is connected to control circuitry to open the uppermost emulsion outlet valve when the oil/water ratio of the emulsion layer at the level of the sensor attains a predetermined value.

4. A desalter according to claim 1 in which the level sensor system is operable to regulate the water level in the vessel at a substantially constant level in the vessel.

5. A desalter according to claim 1 in which the level sensor system is connected to control circuitry for the emulsion withdrawal valves to open the emulsion outlet valves progressively in accordance with the emulsion level in the vessel.

6. A desalter according to claim 1 in which the level sensor system comprises a density profiler.

7. A desalter according to claim 1 in which the level sensor system comprises a density profiler to indicate the maximum emulsion level and a level probe to indicate the interface between the top of the water layer and the bottom of the emulsion layer.

8. A desalter according to claim 1 in which the level sensor system comprises an upper water/oil ratio probe to indicate the maximum emulsion level and a lower water/oil ratio probe to indicate the interface between the top of the water layer and the bottom of the emulsion layer.

9. A desalter according to claim 1 in which the emulsion outlets are connected to a settling vessel to permit the emulsion to settle to remove water from the emulsion.

10. A desalter according to claim 1 in which the emulsion outlets are connected to an emulsion treatment system to separate the emulsion into water and oil, to send the separated oil to refinery processing and the water to a waste water treatment system.

11. A desalter according to claim 10 which comprises a centrifuge connected to the emulsion outlets.

12. A desalter according to claim 11 in which the centrifuge is a decanter centrifuge.

* * * * *